US007490405B2

(12) United States Patent
Sanada

(10) Patent No.: US 7,490,405 B2
(45) Date of Patent: Feb. 17, 2009

(54) METHOD FOR MANUFACTURING A LIQUID DROPLET DISCHARGE HEAD.

(75) Inventor: Kazuo Sanada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 399 days.

(21) Appl. No.: 11/086,592

(22) Filed: Mar. 23, 2005

(65) Prior Publication Data

US 2005/0212863 A1 Sep. 29, 2005

(30) Foreign Application Priority Data

Mar. 24, 2004 (JP) ..... 2004-087804
Mar. 24, 2004 (JP) ..... 2004-087805

(51) Int. Cl.
*B21D 53/76* (2006.01)
*B41J 2/045* (2006.01)

(52) U.S. Cl. ..... 29/890.1; 29/25.35; 29/831; 29/846; 29/852; 347/68; 216/27

(58) Field of Classification Search ..... 29/25.35, 29/890.1, 832, 831, 848, 846, 852, 856; 347/68–70; 216/27; 427/329, 100; 264/452, 453, 434, 264/478

See application file for complete search history.

(56) References Cited

U.S. PATENT DOCUMENTS 3,493,429 A * 2/1970 Mountvala ..... 427/446
4,415,512 A * 11/1983 Torobin ..... 264/9
4,493,137 A * 1/1985 Bader et al. ..... 29/25.35
4,716,418 A 12/1987 Heinzl et al.
4,727,384 A * 2/1988 Tsuda ..... 347/50
4,894,667 A 1/1990 Moriyama
5,548,894 A * 8/1996 Muto ..... 29/890.1
5,725,825 A * 3/1998 Hotomi et al. ..... 264/434
5,776,490 A * 7/1998 Chu et al. ..... 424/451
5,809,646 A * 9/1998 Reinecke et al. ..... 29/890.1
6,248,268 B1 * 6/2001 Cook ..... 264/12

FOREIGN PATENT DOCUMENTS

EP 0 693 379 A2 1/1996
JP 58-203064 A 11/1983
JP 62-179949 A 8/1987
JP 63-260453 A 10/1988
JP 6-23987 A 2/1994
JP 8-20109 A 1/1996
JP 8-336967 A 12/1996
JP 9-277528 A 10/1997
JP 9-300614 A 11/1997
JP 11-348297 A 12/1999
JP 2003-127387 A 5/2003
JP 2003-298132 A 10/2003

* cited by examiner

*Primary Examiner*—Peter Vo
*Assistant Examiner*—Tai Nguyen
(74) *Attorney, Agent, or Firm*—Birch, Stewart, Kolasch & Birch, LLP

(57) ABSTRACT

The liquid droplet discharge head comprises: a piezoelectric actuator shaped in a cylinder having a hollow part; a pressure chamber shaped in a cylinder formed in the hollow part of the piezoelectric actuator; and a droplet discharge port which is communicated with the pressure chamber and is designed for discharging a droplet of liquid in the pressure chamber by means of deformation of the pressure chamber accompanying displacement of the piezoelectric actuator, wherein the piezoelectric actuator has a structure in which displacement characteristics of a piezoelectric member are intermittently or continuously varied along an axial direction of the cylinder.

9 Claims, 14 Drawing Sheets

STEP 1

STEP 4

STEP 2

STEP 5

STEP 3

METHOD FOR MANUFACTURING A LIQUID DROPLET DISCHARGE HEAD.

BACKGROUND OF THE INVENTION

1. Field of the Invention

The present invention relates to a liquid droplet discharge head, a manufacturing method thereof, and an image forming apparatus, and more specifically to the structure of a droplet discharge head that provides a discharge force to a liquid by deforming a piezoelectric member to discharge droplets from a nozzle, to a manufacturing method thereof, and also to an inkjet recording apparatus or another image forming apparatus that forms an image on a recording medium using this liquid discharge head.

2. Description of the Related Art

An inkjet-type recording apparatus deposits ink droplets on a printing medium by moving recording paper or another such printing medium relative to a recording head with nozzles and discharging ink from the nozzles according to a print signal, and forms an image on the printing medium by means of the inkjet.

Japanese Patent Application Publication Nos. 6-23987, 8-20109, 8-336967, 9-277528, and 9-300614 disclose an inkjet recording head that utilizes a cylindrical piezoelectric actuator. The recording head depicted in Japanese Patent Application Publication No. 6-23987 has a structure wherein a plurality of cylindrical tubes having ink spray ports (orifices) are aligned in a row on a pedestal, and the ink in the tubes is pressured and discharged as ink droplets from the orifices by deforming the cylindrical tubes through the electrostriction of an electrostrictive transducer disposed facing the pedestal surface on either side of the row of cylindrical tubes. This same reference publication introduces a system for mounting cylindrical electrostrictive elements on the side of the cylindrical tubes (transducer cylinder system).

Japanese Patent Application Publication No. 8-20109 proposes a method for manufacturing a cylindrical layered piezoelectric member by immersing a holed pattern member containing a part for forming a pillar-shaped pressure chamber alternately in an electrode material solution and a piezoelectric material solution a plurality of times, then performing a baking step.

Japanese Patent Application Publication No. 8-336967 proposes forming a piezoelectric member on the surface of a metal cylinder by a hydrothermal synthesis method.

Japanese Patent Application Publication No. 9-227528 proposes a manufacturing method wherein a plurality of holes are formed at equal intervals in a straight line on a hollow frame that serves as an ink supply unit, a pin composed of a resin wire or the like (a material that vaporizes and disappears in high-temperature environments) is fixed in place in each hole, a piezoelectric material is applied by means of a slurry immersion step onto part of a frame supporting the peripheries and base ends of these pins, the pins are melted by a baking step after drying, and a common electrode is formed on the inner surface of the piezoelectric member while an individual electrode is formed on the outer surface in a plating step.

Japanese Patent Application Publication No. 9-300614 proposes a manufacturing method wherein a plurality of holes are formed at equal intervals in a straight line on a hollow frame that serves as an ink supply unit, a tube-shaped electrode is fixed in place in each hole, a piezoelectric material is applied by means of a slurry immersion step onto part of a frame supporting these tube-shaped electrodes and their base ends, a baking step after drying is conducted, and then an individual electrode is formed on the outer peripheral surface of the piezoelectric member in a plating step.

The so-called cylindrically compressing piezoelectric heads disclosed in Japanese Patent Application Publication Nos. 6-23987, 8-20109, 8-336967, 9-277528, and 9-300614 have merits in that the ink in the cylindrical liquid chamber (in the pressure chamber) is pressurized in the direction facing diametrically inward from the side external periphery; therefore, the ink has a strong flying force.

Currently, however, further improvements in discharge force and higher refilling speeds are needed from the standpoint of diversifying ink liquids, controlling the occurrence of discharge problems, increasing the speed of printing, and the like.

The present invention has been contrived in view of such circumstances, and an object thereof is to provide a droplet discharge head and an image forming apparatus that uses this droplet discharge head, whereby it is possible to improve discharge efficiency and to increase the speed of refilling.

When a system of wrapping a green sheet around a cylindrical tube (glass tube) is used as the method for manufacturing the head as is shown in Japanese Patent Application Publication No. 6-23987, the tube diameter must be increased to allow for ease of handling of the entire tube in the manufacturing step, and therefore the nozzle cannot be provided with a high density.

Otherwise, as shown in Japanese Patent Application Publication Nos. 8-20109, 9-277528, and 9-300614, the method of performing baking after forming a piezoelectric member by immersion is impractical because immersion must be repeated a plurality of times in order to obtain the desired piezoelectric member thickness and plate thickness, which requires a long period of time. Also, limitations are imposed on the electrode materials that can be used in a system of applying the electrode material before baking, because the baking temperature must be set to a temperature equal to or greater than either the boiling point of stainless steel (SUS) or nickel (Ni), or the temperature that accompanies oxidizing deterioration. Therefore, sometimes the electrode cannot be formed by plating or another such simple method, which restricts the process.

Also, the hydrothermal synthesis method disclosed in Japanese Patent Application Publication No. 8-336967 is impractical because the base that can be used is mostly limited to titanium, and therefore there is no freedom in choosing the base material, and also because the film adheres slowly.

SUMMARY OF THE INVENTION

The present invention has been contrived in view of such circumstances, and an object thereof is to provide a practical method of manufacturing a droplet discharge head wherein the droplet discharge port (nozzle) can be provided with a high density and there is a high degree of freedom in selecting materials; and also to provide an image forming apparatus that uses the droplet discharge head obtained by this manufacturing method.

In order to attain the aforementioned object, the present invention is directed to a liquid droplet discharge head, comprising: a piezoelectric actuator shaped in a cylinder having a hollow part; a pressure chamber shaped in a cylinder formed in the hollow part of the piezoelectric actuator; and a droplet discharge port which is communicated with the pressure chamber and is designed for discharging a droplet of liquid in the pressure chamber by means of deformation of the pressure chamber accompanying displacement of the piezoelectric actuator, wherein the piezoelectric actuator has a structure in which displacement characteristics of a piezoelectric member are intermittently or continuously varied along an axial direction of the cylinder.

In the droplet discharge head of the present invention, forming the pressure chamber on the inner side (hollow part) of the cylindrical piezoelectric actuator and deforming the pressure chamber by driving the piezoelectric actuator results in the pressure being varied on the liquid in the pressure chamber, and liquid droplets being discharged from the droplet discharge port. It is possible to make the displacement amount, deformation amount, displacement timing, and the like differ in the axial direction during application of the drive voltage to obtain the desired displacement distribution (specifically, pressure distribution) by means of a structure wherein the displacement characteristics of the piezoelectric actuator differ in the axial direction of the cylinder shape.

Vibration of the pressure chamber walls can be thereby achieved whereby the flow of liquid in the axial direction can be promoted more so than in a conventional configuration in which the sides of the pressure chamber are uniformly deformed, and the discharge force can be improved and the speed of refilling can be increased. Therefore, it is possible to discharge highly viscous liquid at a high speed.

Preferably, the piezoelectric actuator has a structure in which compositions of the piezoelectric member are varied intermittently or continuously along the axial direction.

The piezoelectric constant can be varied by varying the composition (components and mixture ratio thereof) of the material of the piezoelectric members constituting the piezoelectric actuator, and the desired displacement characteristics can be obtained.

Alternatively, the piezoelectric actuator has a structure in which a thickness of the piezoelectric member is varied intermittently or continuously along the axial direction.

Instead of an embodiment wherein the composition of the piezoelectric material differs, another possibility that can be used separately or together with this embodiment is an embodiment wherein the displacement characteristics are varied by varying the thickness of the piezoelectric layer.

Preferably, the piezoelectric member is formed by spray deposition.

Spray deposition is a technique of forming a film by blowing and depositing a pulverulent material onto a substrate at high speeds, and is also referred to as aerosol deposition or gas deposition. The piezoelectric actuator in the present invention is preferably formed using the aerosol deposition method. It is possible to form not only the piezoelectric layer but also the electrode layers on either side of the piezoelectric layer by the aerosol deposition method. The aerosol deposition method has merits in that a thick film can easily be formed compared to sputtering and other such deposition methods, and a crystallized structure can be maintained in the raw material powder.

In order to attain the aforementioned object, the present invention is also directed to an image forming apparatus, comprising: the droplet discharge head as described above, wherein an image is formed on a recording medium by droplets discharged from the droplet discharge port.

For example, a desired dot apparatus that discharges droplets from a droplet discharge port (nozzle) by controlling the piezoelectric actuator on the basis of image data can be implemented as the droplet discharge head applied in the image forming apparatus.

One structural example that can be used as the droplet discharge head is a full-line inkjet head that has a nozzle row where a plurality of nozzles for ink discharge are aligned across a length corresponding to the entire width of the recording medium.

In this case, another possibility is an embodiment wherein a nozzle row is configured to correspond to the entire width of the recording medium by combining a plurality of relatively short discharge head blocks having nozzle rows that do not extend to a length corresponding to the entire width of the recording medium, and linking these discharge head blocks.

A "full-line recording head (droplet discharging head)" is normally disposed along the direction orthogonal to the relative feed direction (direction of relative movement) of the printing medium, but also possible is an aspect in which the recording head is disposed along the diagonal direction given a predetermined angle with respect to the direction orthogonal to the feed direction.

The "recording medium" is a medium (an object that may be referred to as a print medium, image formation medium, recording medium, image receiving medium, or the like) that receives images recorded by the action of the recording head and includes continuous paper, cut paper, seal paper, OHP sheets, and other resin sheets, as well as film, cloth, printed substrates on which wiring patterns or the like are formed with an inkjet recording apparatus, and various other media without regard to materials or shapes. In the present specification, the term "printing" expresses the concept of not only the formation of characters, but also the formation of images with a broad meaning that includes characters.

The term "moving device (conveyance device)" includes an aspect in which the printing medium is moved with respect to a stationary (fixed) recording head, an aspect in which the recording head is moved with respect to a stationary printing medium, or an aspect in which both the recording head and the printing medium are moved.

In order to attain the aforementioned object, the present invention is also directed to a method for manufacturing a liquid droplet discharge head having a plurality of droplet discharge ports and piezoelectric actuators for creating pressure variation in liquid in pressure chambers communicated with the droplet discharge ports to discharge droplets of the liquid from the droplet discharge ports, the method comprising the steps of: using a molded member having hollow cylindrical shapes constituting the pressure chambers to deposit particles of a piezoelectric material by spray deposition on inner walls of the molded member to form cylindrical piezoelectric members; and forming electrodes on inner walls of the cylindrical piezoelectric members.

According to the present invention, a molded member with a hollow cylindrical shape is prepared, and a cylindrical piezoelectric layer is formed along the shape of the inner wall of the molded member by bonding the piezoelectric members to the inner side of the molded member by utilizing spray deposition. When the molded member is formed from a resin or another nonconductive material, a step of forming an electrode (first electrode) on the inner peripheral surface of the molded member is added before the piezoelectric member formation step. However, when the molded member is formed from a metal or another such conductive material, the step for forming the first electrode can be omitted because the molded member itself can function as an electrode (first electrode).

The piezoelectric actuator in the present invention is formed on the inner side of the molded member utilizing the aerosol deposition method.

Also, after the piezoelectric members are formed on the inner wall of the molded member by the aerosol deposition method, another electrode (second electrode) is formed on the inner peripheral surfaces of the piezoelectric members. In this manner, a cylindrical piezoelectric actuator is formed on the inner side of the molded member. The electrodes on either side of the piezoelectric members may be formed by plating, vapor deposition, or other such conventional methods, or they may also be formed by the aerosol deposition method.

According to the present invention, it is possible to form the molded member with a relatively low thickness, to form the piezoelectric actuator into a thin tube because the piezoelectric members and electrodes are formed from the inner side of the cylindrical molded member, and to dispose the droplet discharge ports, the corresponding pressure chamber, and the discharge element composed of the piezoelectric actuator at a high density. A one-dimensional alignment (line alignment), a two-dimensional alignment (matrix alignment), or other such various alignment configurations can be used for the alignment configuration of the droplet discharge ports.

Furthermore, since the aerosol deposition method is utilized, the present invention has merits in that there is a high degree of freedom in the materials that can be used, and there are few restrictions on manufacturing.

Preferably, the molded member is disposed two-dimensionally according to an alignment configuration of the droplet discharge ports.

The droplet discharge ports can be further increased in density by disposing the hollow molded member corresponding to each pressure chamber aligned in a two-dimensional matrix structure.

Preferably, a spray nozzle for spraying microparticles is inserted in an inner side of the molded member; and the piezoelectric members are sequentially formed in an axial direction of the molded member by spraying particles of at least the piezoelectric material from the spray nozzle.

For example, a preferred embodiment is one wherein piezoelectric members are sequentially formed from one end of the molded member along the axial direction.

Preferably, compositions of the piezoelectric members are varied intermittently or continuously along the axial direction.

Using a manufacturing method for sequentially forming piezoelectric members in the axial direction by the aerosol deposition method makes it possible to vary the compositions of the piezoelectric members in the axial direction. The piezoelectric constant can be varied by varying the composition (components and mixture ratios) of the material of the piezoelectric members constituting the piezoelectric actuator, and it is possible to obtain the desired displacement characteristics.

Alternatively, a thickness of the piezoelectric members is varied intermittently or continuously along the axial direction.

Instead of an embodiment wherein the composition of the piezoelectric material differs, another possibility that can be used separately or together with this embodiment is an embodiment wherein the displacement characteristics are varied by varying the thickness of the piezoelectric layer.

A structure wherein the displacement characteristics of the piezoelectric actuator are made to differ in the axial direction of the cylinder makes it possible to vary the extent of displacement, the position of deformation, the displacement timing, and the like in the axial direction during application of a drive voltage, and to obtain the desired displacement distribution (specifically, the pressure distribution).

Vibration of the pressure chamber walls can thereby be achieved wherein the flow of a liquid in the axial direction is further promoted than in a configuration for uniformly deforming the sides of the pressure chamber, and discharge force can be improved while the speed of refilling can be increased. It is therefore possible to discharge highly viscous liquids and to discharge the liquids at high speeds.

Preferably, the plurality of droplet discharge ports are formed on a plate member bonded to ends of the molded members in the axial direction.

The plate member may be utilized as a supporting plate for supporting the molded member while the piezoelectric members are formed by the aerosol deposition method, and may also be a nozzle plate formed separately from the supporting plate.

Preferably, a flow channel of the pressure chamber formed on an inner side of the cylindrical piezoelectric member has a substantially circular cross section; and an inner diameter of the pressure chamber progressively decreases towards the droplet discharge port at the end in the axial direction.

The preferred embodiment has a structure wherein the inner diameter (specifically, the cross sectional area of the flow channel) of the pressure chamber progressively decreases towards the droplet discharge ports formed in the end of the pressure chamber in the axial direction to form a profluent flow channel. It is thereby possible to avoid pressure losses and unsatisfactory discharges due to the accumulation of air bubbles.

In order to attain the aforementioned object, the present invention is also directed to an image forming apparatus, comprising: the droplet discharge head manufactured according to the method as described above, wherein an image is formed on a recording medium by droplets discharged from the droplet discharge ports.

According to the present invention, a cylindrical piezoelectric actuator has a structure wherein the displacement characteristics of the piezoelectric members are varied intermittently or continuously in the axial direction. Therefore, it is possible to vary the extent of displacement, the position of deformation, the displacement timing, and the like in the axial direction during application of a drive voltage, to further promote the flow of liquid in the axial direction, and to improve discharge force while the speed of refilling is increased.

Also, according to the method for manufacturing a droplet discharge head relating to the present invention, since piezoelectric members are formed on the inner side of a molded member with a hollow cylindrical shape by the use of the aerosol deposition method, it is possible to dispose the molded member at a high density, to form the piezoelectric actuator into a thin tube, and to increase the density of the droplet discharge ports. Also, the present invention has merits in that there is a high degree of freedom in choosing materials that can be used, there are few restrictions on manufacturing, and it is possible to improve productivity.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
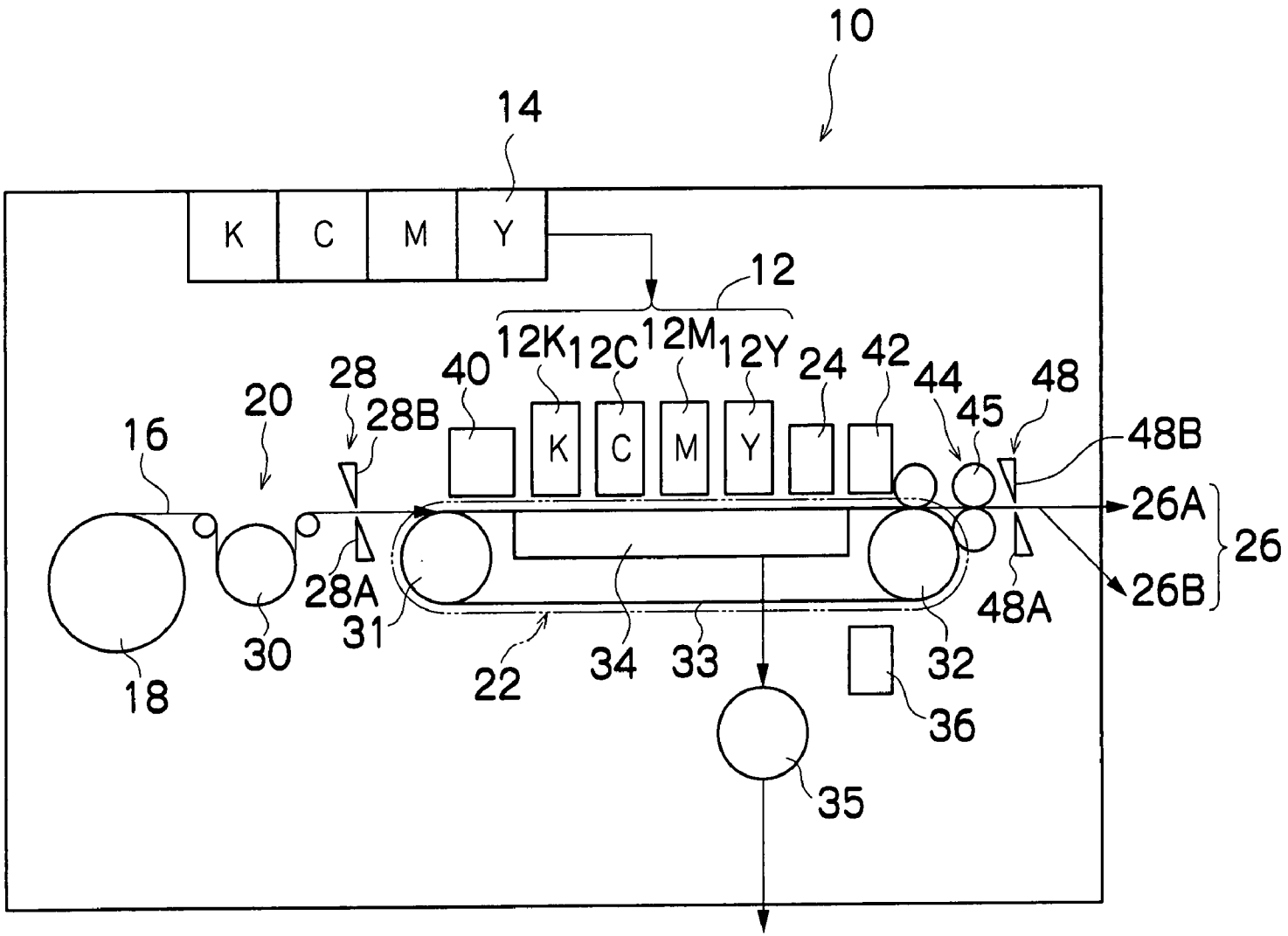
FIG. 1 is a general schematic drawing of an inkjet recording apparatus including a liquid droplet discharge head according to an embodiment of the present invention.

FIG. 1 is a general schematic drawing of an inkjet recording apparatus including a liquid droplet head according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

The ink storing and loading unit 14 has tanks for storing the inks of K, C, M and Y to be supplied to the print heads 12K, 12C, 12M, and 12Y, and the tanks are connected to the print heads 12K, 12C, 12M, and 12Y through channels (not shown), respectively. The ink storing and loading unit 14 has a warning device (e.g., a display device, an alarm sound generator) for warning when the remaining amount of any ink is low, and has a mechanism for preventing loading errors among the colors.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet discharge is controlled so that the ink-droplets are discharged in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown in FIG. 1, but shown as a motor 188 in FIG. 9) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
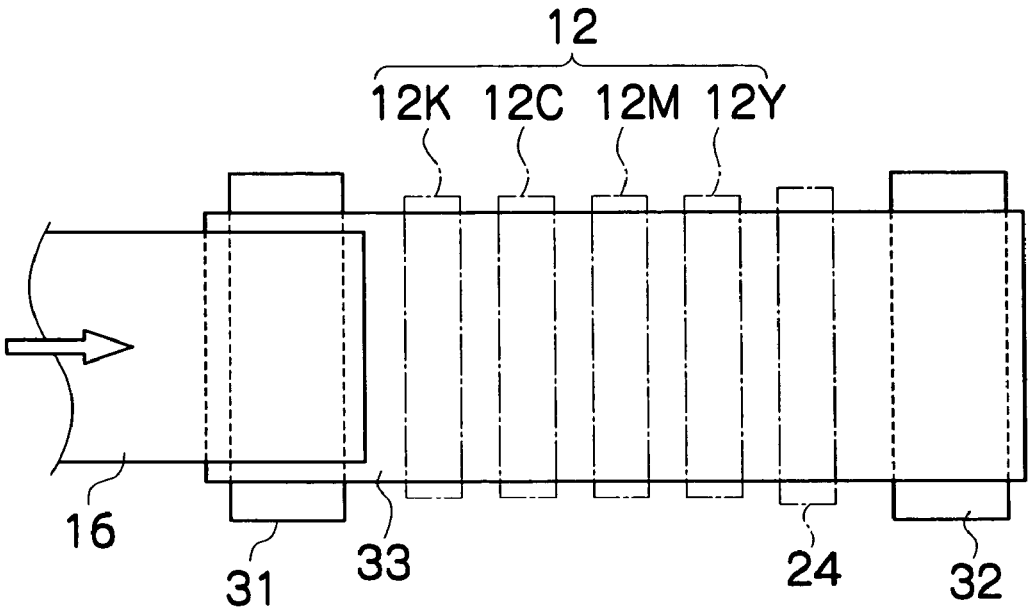
FIG. 2 is a plan view of principal components of an area around a printing unit of the inkjet recording apparatus in FIG. 1.

Each of the print heads 12K, 12C, 12M, and 12Y of the printing unit 12 is composed of a so-called full-line head having a length that corresponds to the maximum paper width intended for use in the inkjet recording apparatus 10, in which a plurality of ink-droplet ejection apertures (nozzles) are arranged along a length that exceeds at least one side of the maximum-size recording paper 16 (i.e., along the entire width of the printable area in the recording paper 16) (see FIG. 2).

The print heads 12K, 12C, 12M, and 12Y are arranged in this order from the upstream side along the direction substantially perpendicular to the delivering direction of the recording paper 16 (hereinafter referred to as the paper conveyance direction). A color print can be formed on the recording paper 16 by ejecting the inks from the print heads 12K, 12C, 12M, and 12Y, respectively, onto the recording paper 16 while conveying the recording paper 16.

The printing unit 12, in which the full-line heads covering the entire width of the paper are thus provided for the respective ink colors, can record an image over the entire surface of the recording paper 16 by performing the action of moving the recording paper 16 and the printing unit 12 relatively to each other in the paper conveyance direction (sub-scanning direction) just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added. In addition, the arrangement order of the print heads 12K, 12C, 12M, and 12Y is not limited to those.

As shown in FIG. 1, the print determination unit 24 has an image sensor for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the ejection of each head is determined. The ejection determination includes the presence of the ejection, measurement of the dot size, and measurement of the dot deposition position.

The post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of Print Head

Next, the structure of the print heads is described. The print heads 12K, 12C, 12M and 12Y have the same structure, and a reference numeral 50 is hereinafter designated to any of the print heads 12K, 12C, 12M and 12Y.

Figure 3A:
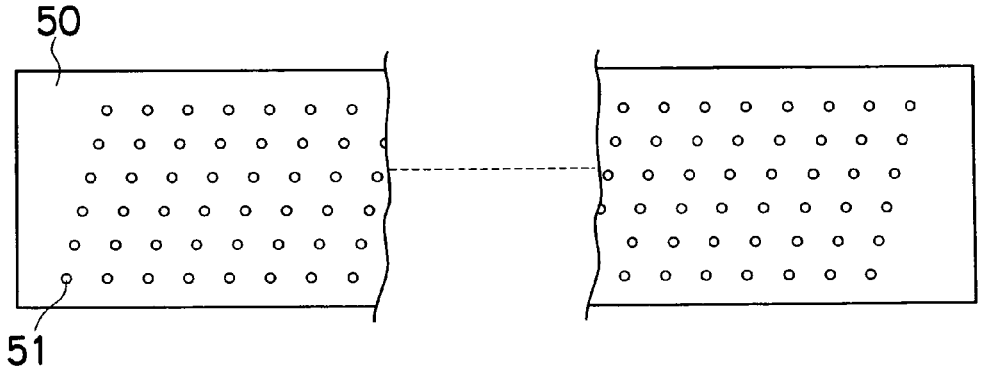
FIG. 3A is a perspective plan view showing an example of a configuration of a print head.
Figure 3B:
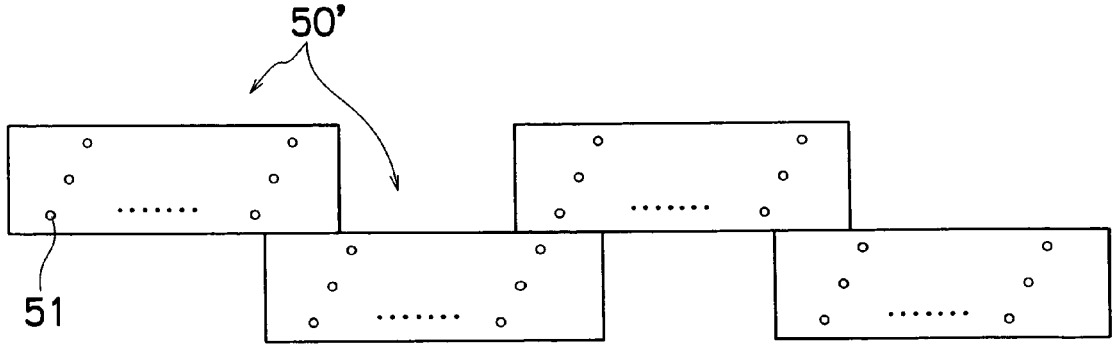
FIG. 3B is a perspective plan view showing another example of the configuration of the full-line type print head.

FIG. 3A is a perspective plan view showing an example of the configuration of the print head 50, and FIG. 3B is a perspective plan view showing another example of the configuration of the print head. The nozzle pitch in the print head 50 should be minimized in order to maximize the density of the dots printed on the surface of the recording paper. As shown in FIG. 3A, the print head 50 in the present embodiment has a structure in which a plurality of ink chamber units 53 including nozzles 51 for ejecting ink-droplets and pressure chambers 52 connecting to the nozzles 51 are disposed in the (two-dimensional) form of a staggered matrix, and the effective nozzle pitch (the projective nozzle pitch) is thereby made small along the longitudinal direction of the print head 50 (along the direction opposite to the paper conveyance direction).

The print head 50 in the present embodiment is not limited to a configuration in which one or more nozzle rows in which the ink discharging nozzles 51 are arranged along a length corresponding to the entire width of the recording paper 16 in the direction substantially perpendicular to the paper conveyance direction. Alternatively, as shown in FIG. 3B, a full-line head can be composed of a plurality of short two-dimensionally arrayed head units 50' arranged in the form of a staggered matrix and combined so as to form nozzle rows having lengths that correspond to the entire width of the recording paper 16.

Figure 4:
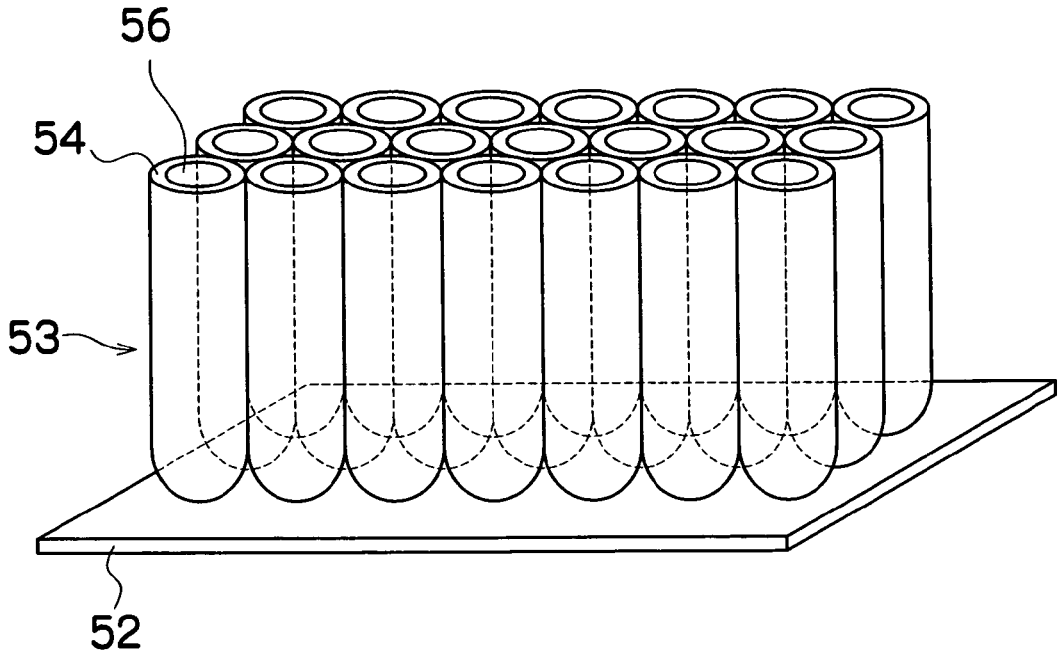
FIG. 4 is a schematic perspective view showing an example of a configuration of a piezoelectric actuator.

FIG. 4 is schematic perspective view showing internal structure of the print head 50. A numeral 52 in FIG. 4 is a nozzle plate, in which a plurality of nozzles 51 are formed in the prescribed two-dimensional arrangement as shown in FIGS. 3A and 3B. A numeral 53 is an ink chamber unit (liquid droplet discharge element) corresponding to each of the nozzles 51.

As shown in FIG. 4, the piezoelectric actuators 54 constituting each of the ink chamber units 53 have a substantially cylindrical shape, and are disposed two-dimensionally on the surface of the nozzle plate 52 so that the axial direction thereof is substantially orthogonal to the nozzle plate 52. The arrangement configuration of the piezoelectric actuators 54 corresponds to the arrangement configuration of the nozzles 51 provided to the nozzle plate 52, and the hollow parts (inner side space) in the piezoelectric actuators 54 form pressure chambers 56 communicated with the nozzles 51.

Figure 5:
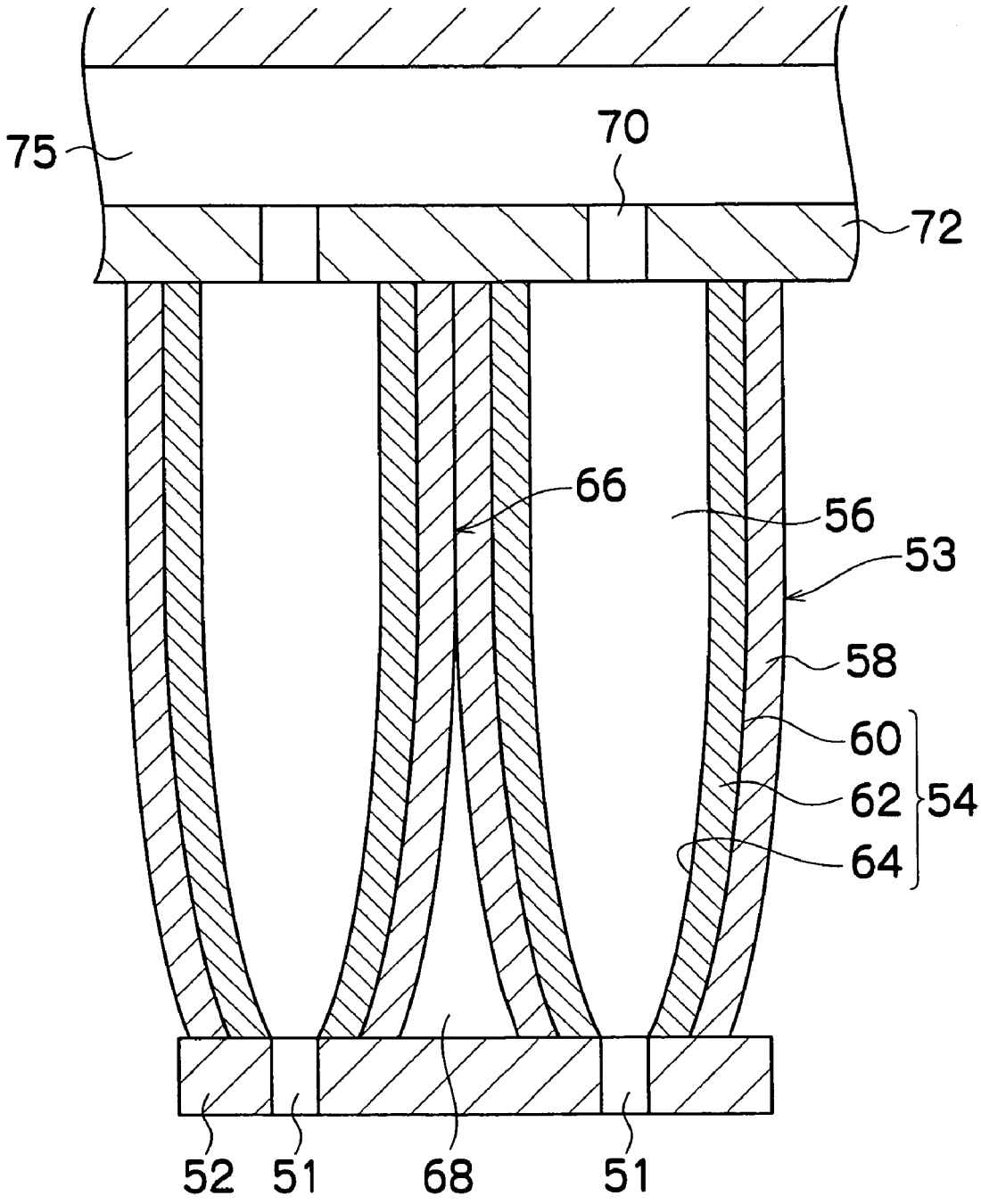
FIG. 5 is a cross-sectional view showing the three-dimensional configuration of a droplet discharge element (the ink chamber unit corresponding to each nozzle)

FIG. 5 is a cross-sectional view showing the structure of the ink chamber units 53. This diagram shows a cross-sectional view cut along a surface including the center axes of two adjacent ink chamber units 53.

In FIG. 5, the numeral 58 is a resin mold for supporting a piezoelectric actuator 54, 60 is an outer electrode, 62 is a piezoelectric member, and 64 is an internal electrode. In the present example, the external electrode 60 serves as a common electrode for the plurality of piezoelectric actuators 54, and the internal electrode 64 is an individual electrode separate from each piezoelectric actuator 54, but it is also possible to use a configuration wherein this relationship is reversed. Also, if a mold made of metal is used instead of the resin mold 58, then it is possible to also use the metal mold itself as an electrode, and the external electrode 60 can be omitted. It is also preferable to provide the inner side of the internal electrode 64 with a treated layer that has been subjected to ink resistant treatment.

The resin mold 58 has a substantially cylindrical hollowed structure, and is configured so that the area near the nozzle 51 becomes gradually smaller in diameter towards the nozzle 51. Also, the resin mold 58 is preferably formed from a material that is sufficiently soft so as to be capable of deforming in accordance with the deformation of the piezoelectric member 62.

Parts of the resin molds 58 of adjacent ink chamber units 53 (the part shown by the numeral 66) are in contact with each other, but a hollow part 68 is formed in the area near the nozzle 51. This hollow part 68 makes it possible to prevent interference to the operation between adjacent nozzles. The contact part shown by the numeral 66 may be linked integrally or may be divided.

A supply hole plate 72 having supply holes 70 is placed on the ends of the cylindrical piezoelectric actuators 54 opposite of the nozzle plate 52. The pressure chambers 56 are communicated with a common flow channel 75 via the supply holes 70. The common flow channel 75 is communicated with an ink tank as an ink supply source (not shown in FIG. 5, denoted by the numeral 160 in FIG. 8), and the ink supplied from the ink tank 160 is distributed and supplied to the pressure chambers 56 via the common flow channel 75 in FIG. 5.

The piezoelectric members 62 deform to vary the capacity of the pressure chambers 56 by the application of a drive voltage between the external electrode 60 and the internal electrode 64, and ink is discharged from the nozzles 51 by the accompanying pressure variation. After ink discharge, new ink is supplied from the common flow channel 75 through the supply holes 70 to the pressure chambers 56.

Figure 6:
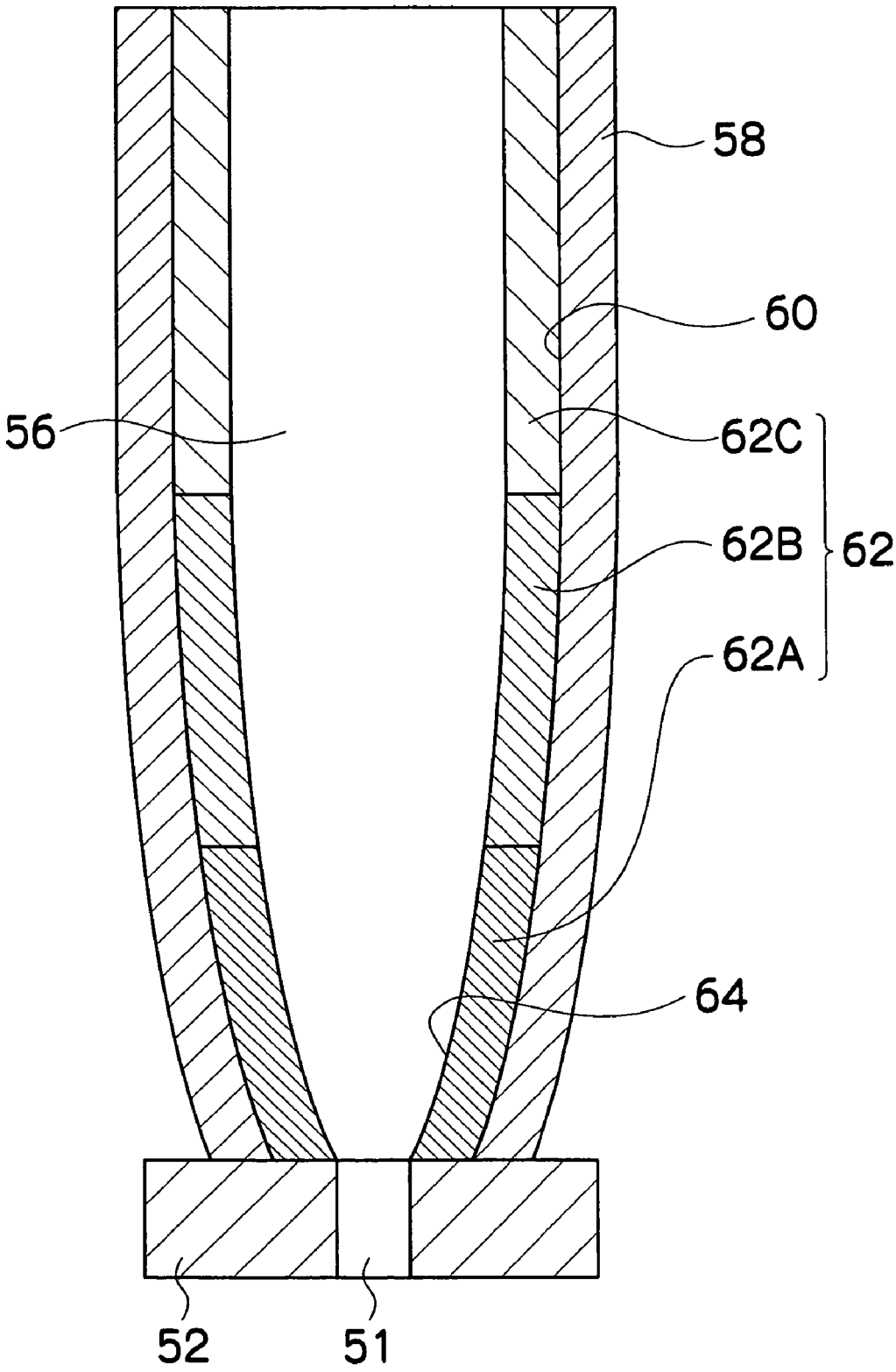
FIG. 6 is a cross-sectional view schematically depicting a structural example of the piezoelectric actuator.

FIG. 6 is a cross-sectional view schematically depicting a structural example of a piezoelectric member 62. As shown in FIG. 6, the piezoelectric member 62 has a structure wherein the composition of the piezoelectric material varies intermittently along the axial direction. In this diagram, the piezoelectric member includes a first piezoelectric member part 62A composed of a first compositional material, a second piezoelectric member part 62B composed of a second compositional material, and a third piezoelectric member part 62C composed of a third compositional material, in said order from the side near the nozzle 51. Of course, the varying configuration of the composition is not particularly limited, and it is possible to appropriately design for the number of intermittently varying areas, the balance of the size of the areas, and the magnitude relation of the piezoelectric constants. Also, the composition of the piezoelectric member 62 may be varied continuously in the axial direction.

Possible examples that can be used for the piezoelectric material include lead zirconate titanate, barium titanate, lead titanate, lead metaniobate, and the like.

The individual electrode (the internal electrode 64 herein) is an integrally molded electrode that is common for the first piezoelectric member part 62A, the second piezoelectric member part 62B, and the third piezoelectric member part 62C, but separately molded electrodes corresponding to the piezoelectric member parts (62A, 62B and 62C) can also be used.

Figure 7:
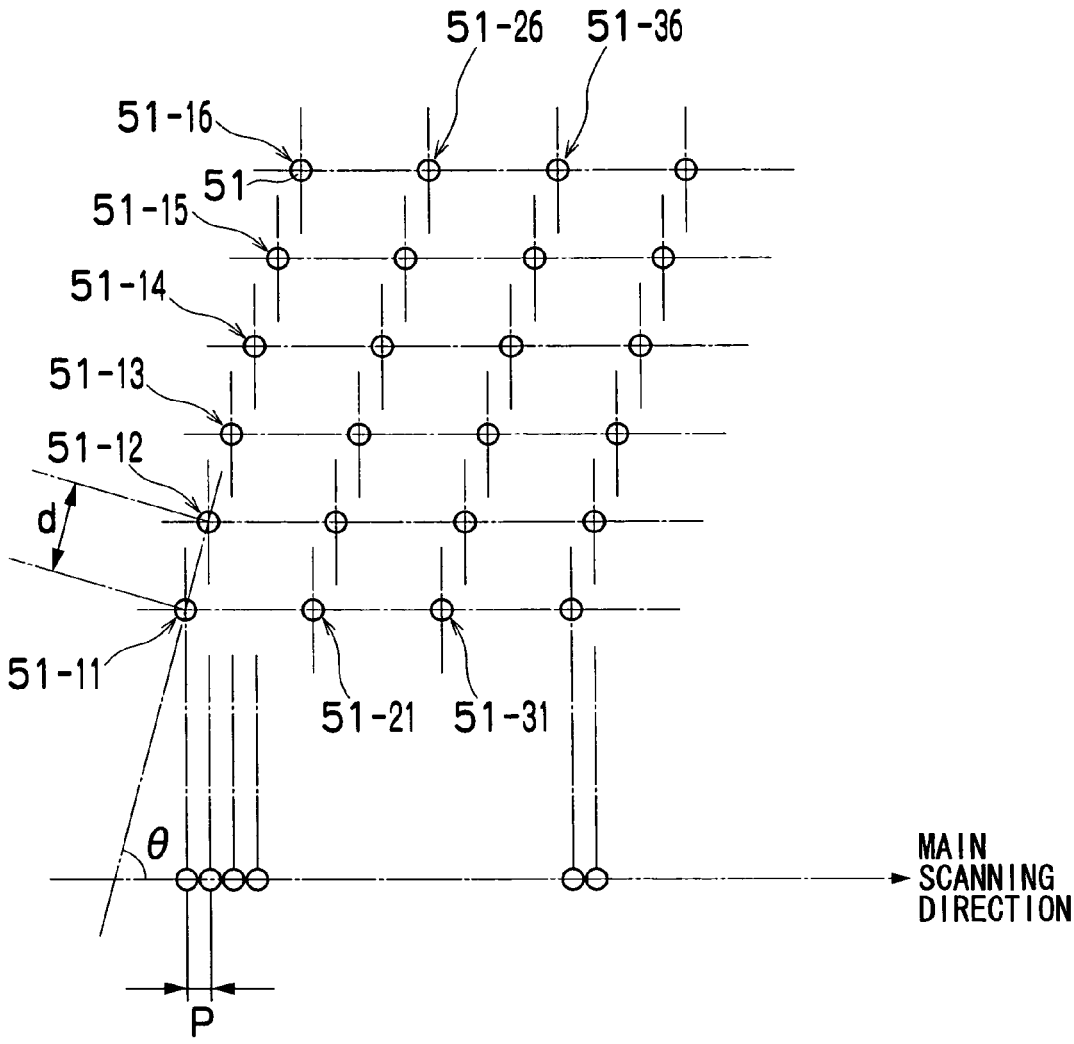
FIG. 7 is an enlarged view showing the nozzle arrangement of the print head.

The plurality of the ink chamber units 53 having such a structure described in FIGS. 4 to 6, are arranged in a grid with a fixed pattern in the line-printing direction along the main scanning direction and in the diagonal-row direction forming a fixed angle θ that is not a right angle with the main scanning direction, as shown in FIG. 7. With the structure in which the plurality of rows of ink chamber units 53 are arranged at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high nozzle density of up to 2,400 nozzles per inch (npi).

In a full-line head comprising rows of nozzles that have a length corresponding to the entire width of the paper (the recording paper 16), the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 7 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

The "main scanning direction" is described as the direction of one line recorded by the above-described main scanning, the "sub-scanning direction" is described as the direction performing the above-described sub-scanning. More specifically, in the present embodiment, the delivering direction of the recording paper 16 is the sub-scanning direction, and the direction perpendicular to the sub-scanning direction is the main scanning direction.

Configuration of Ink Supply System

Figure 8:
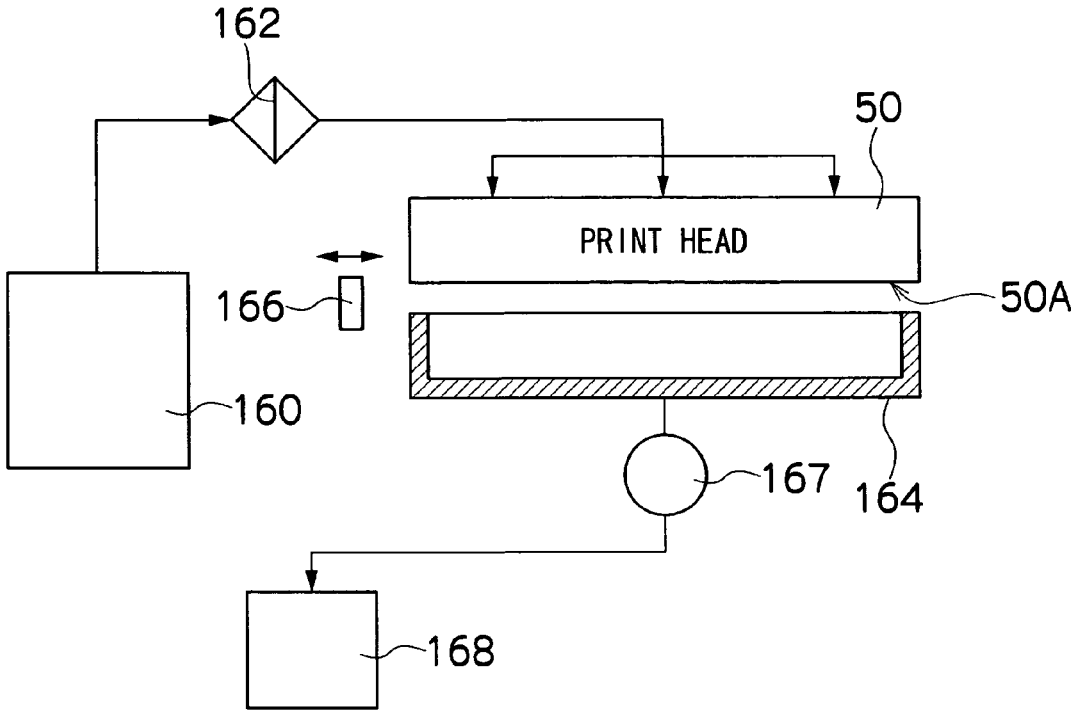
FIG. 8 is a schematic drawing showing a configuration of an ink supply system in the inkjet recording apparatus.

FIG. 8 is a schematic drawing showing the configuration of the ink supply system in the inkjet recording apparatus 10. An ink supply tank 160 is a base tank that supplies ink and is set in the ink storing and loading unit 14 described with reference to FIG. 1. The aspects of the ink supply tank 160 include a refillable type and a cartridge type: when the remaining amount of ink is low, the ink supply tank 160 of the refillable type is filled with ink through a filling port (not shown) and the ink supply tank 160 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 160 in FIG. 6 is equivalent to the ink storing and loading unit 14 in FIG. 1 described above.

A filter 162 for removing foreign matters and bubbles is disposed between the ink supply tank 160 and the print head 50 as shown in FIG. 8. The filter mesh size in the filter 162 is preferably equivalent to or less than the diameter of the nozzle and commonly about 20 μm. Although not shown in FIG. 8, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 164 as a device to prevent the nozzles 51 from drying out or to prevent an increase in the ink viscosity in the vicinity of the nozzles 51, and a cleaning blade 166 as a device to clean the nozzle face. A maintenance unit including the cap 164 and the cleaning blade 166 can be moved in a relative fashion with respect to the print head 50 by a movement mechanism (not shown), and is moved from a predetermined holding position to a maintenance position below the print head 50 as required.

The cap 164 is displaced up and down in a relative fashion with respect to the print head 50 by an elevator mechanism (not shown). When the power of the inkjet recording apparatus 10 is switched OFF or when in a print standby state, the cap 164 is raised to a predetermined elevated position so as to come into close contact with the print head 50, and the nozzle face is thereby covered with the cap 164.

The cleaning blade 166 is composed of rubber or another elastic member, and can slide on the ink discharge surface (surface of the nozzle plate) of the print head 50 by means of a blade movement mechanism (not shown). When ink droplets or foreign matter has adhered to the nozzle plate, the surface of the nozzle plate is wiped, and the surface of the nozzle plate is cleaned by sliding the cleaning blade 166 on the nozzle plate.

During printing or standby, when the frequency of use of specific nozzles is reduced and ink viscosity increases in the vicinity of the nozzles, a preliminary discharge is made toward the cap 164 to discharge the degraded ink.

Also, when bubbles have become intermixed in the ink inside the print head 50 (inside the pressure chamber), the cap 164 is placed on the print head 50, ink (ink in which bubbles have become intermixed) inside the pressure chamber is removed by suction with a suction pump 67, and the suction-removed ink is sent to a collection tank 68. This suction action entails the suctioning of degraded ink whose viscosity has increased (hardened) when initially loaded into the head, or when service has started after a long period of being stopped.

When a state in which ink is not discharged from the print head 50 continues for a certain amount of time or longer, the ink solvent in the vicinity of the nozzles 51 evaporates and ink viscosity increases. In such a state, ink can no longer be discharged from the nozzle 51 even if the piezoelectric actuator 54 for driving discharge is operated. Before reaching such a state the piezoelectric actuator 54 is operated (in a viscosity range that allows discharge by the operation of the piezoelectric actuator 54), and the preliminary discharge is made toward the ink receptor to which the ink whose viscosity has increased in the vicinity of the nozzle is to be discharged. After the nozzle surface is cleaned by a wiper such as the cleaning blade 166 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 56, or when the ink viscosity inside the nozzle 51 has increased over a certain level, ink can no longer be discharged by the preliminary discharge, and a suctioning action is carried out as follows.

More specifically, when bubbles have become intermixed in the ink inside the nozzle 51 and the pressure chamber 56, ink can no longer be discharged from the nozzles even if the actuator 54 is operated. Also, when the ink viscosity inside the nozzle 51 has increased over a certain level, ink can no longer be discharged from the nozzle 51 even if the piezoelectric actuator 54 is operated. In these cases, a suctioning device to remove the ink inside the pressure chamber 56 by suction with a suction pump, or the like, is placed on the nozzle face of the print head 50, and the ink in which bubbles have become intermixed or the ink whose viscosity has increased is removed by suction.

However, this suction action is performed with respect to all the ink in the pressure chamber 56, so that the amount of ink consumption is considerable. Therefore, a preferred aspect is one in which a preliminary discharge is performed when the increase in the viscosity of the ink is small.

Description of Control System

Figure 9:
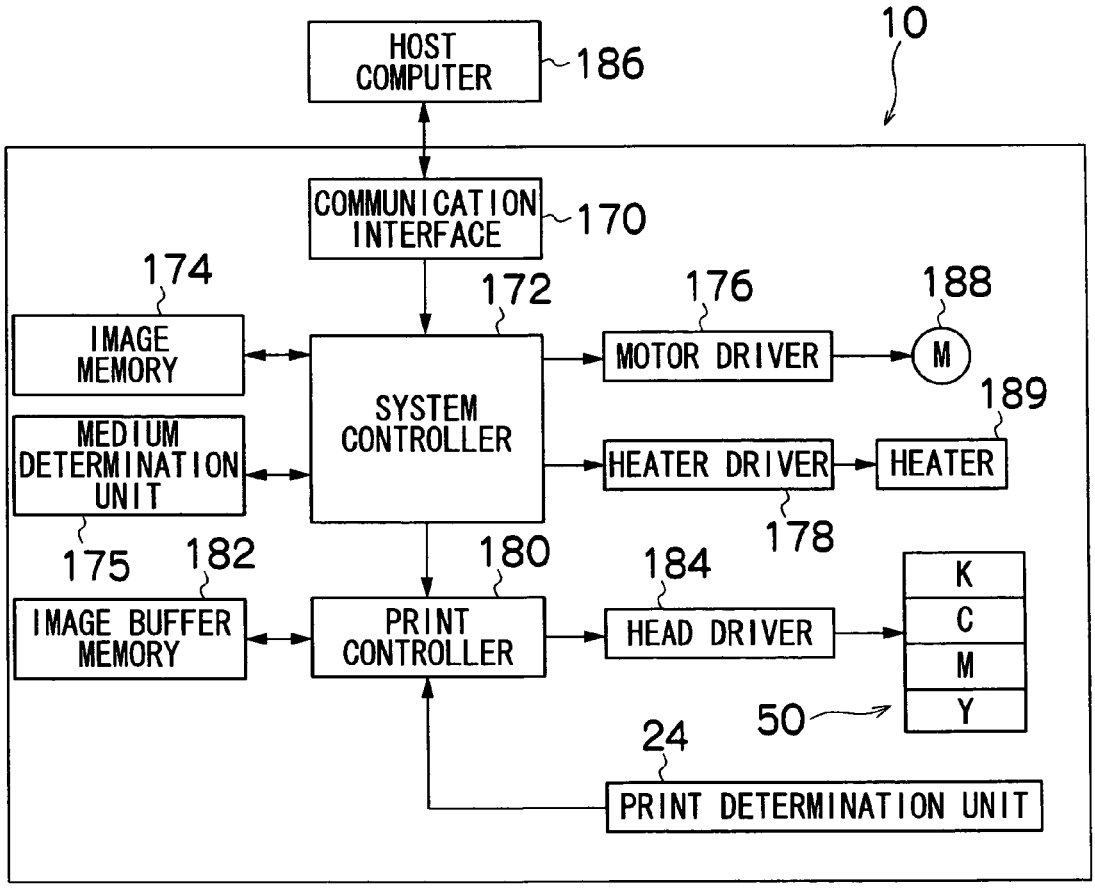
FIG. 9 is a principal block diagram showing the system composition of the inkjet recording apparatus.

Next, the control system of the inkjet recording apparatus 10 is described. FIG. 9 is a block diagram of the principal components showing the system configuration of the inkjet recording apparatus 10. The inkjet recording apparatus 10 has a communication interface 170, a system controller 172, an image memory 174, a motor driver 176, a heater driver 178, a print controller 180, an image buffer memory 182, a head driver 184, and other components.

The communication interface 170 is an interface unit for receiving image data sent from a host computer 186. A serial interface such as USB, IEEE1394, Ethernet, wireless network, or a parallel interface such as a Centronics interface may be used as the communication interface 170. A buffer memory (not shown) may be mounted in this portion in order to increase the communication speed.

The image data sent from the host computer 186 is received by the inkjet recording apparatus 10 through the communication interface 170, and is temporarily stored in the image memory 174. The image memory 174 is a storage device for temporarily storing images inputted through the communication interface 170, and data is written and read to and from the image memory 174 through the system controller 172. The image memory 174 is not limited to memory composed of a semiconductor element, and a hard disk drive or another magnetic medium may be used.

The system controller 172 controls the communication interface 170, image memory 174, motor driver 176, heater driver 178, and other components. The system controller 172 has a central processing unit (CPU), peripheral circuits therefor, and the like. The system controller 172 controls communication between itself and the host computer 186, controls reading and writing from and to the image memory 174, and performs other functions, and also generates control signals for controlling a heater 189 and the motor 188 in the conveyance system.

The motor driver (drive circuit) 176 drives the motor 188 in accordance with commands from the system controller 172. The heater driver (drive circuit) 178 drives the heater 189 of the post-drying unit 42 or the like in accordance with commands from the system controller 172.

A medium determination unit 175 is a means for determining the type and size (paper width) of the recording paper 16. Possible examples that can be used include a means for reading a barcode or other such information on a magazine in the paper supply unit, a sensor disposed at an appropriate location on the paper conveyance path (paper width determination sensor, a sensor for determining the thickness of the paper, a sensor for determining the reflectivity of the paper, and the like), or a suitable combination of these examples. Another possibility that can be used in place of, or together with, these automatic determination means is a configuration wherein the type of paper, the size, and other such information is specified by an input from a specific user interface.

The information acquired by the medium determination unit 175 is transmitted to the system controller 172 and is utilized for ink discharge control and the like.

The print control unit 180 is a control unit having a signal processing function for performing various treatment processes, corrections, and the like, in accordance with the control implemented by the system controller 172, in order to generate a signal for controlling printing, from the image data in the image memory 174, and it supplies the print control signal (image data) thus generated to the head driver 184. Prescribed signal processing is carried out in the print control unit 180, and the discharge amount and the discharge timing of the ink droplets from the respective print heads 50 are controlled via the head drier 184, on the basis of the image data. By this means, prescribed dot size and dot positions can be achieved.

The print controller 180 is provided with the image buffer memory 182; and image data, parameters, and other data are temporarily stored in the image buffer memory 182 when image data is processed in the print controller 180. The aspect shown in FIG. 9 is one in which the image buffer memory 182 accompanies the print controller 180; however, the image memory 174 may also serve as the image buffer memory 182. Also possible is an aspect in which the print controller 180 and the system controller 172 are integrated to form a single processor.

The head driver 184 drives the piezoelectric actuators 54 for driving the discharge of the print head 50 of the respective colors on the basis of the print data received from the print controller 180. A feedback control system for keeping the drive conditions for the print heads constant may be included in the head driver 184.

The data for the image to be printed is inputted externally via the communication interface 170 and is stored in the image memory 174. In this stage, for example, RGB image data is stored in the image memory 174. The image data stored in the image memory 174 is sent to the print controller 180 via the system controller 172, and is converted to dot data for each ink color in the print controller 180 by a conventional dither method, an error diffusion method, or another such method.

Thus, the driving of the head 50 is controlled and ink is discharged from the head 50 on the basis of the dot data created in the print controller 180. An image is formed on the recording paper 16 by controlling the discharge of ink from the head 50 synchronously with the speed at which the recording paper 16 is conveyed.

As described in FIG. 1, the print determination unit 24 is a block containing a line sensor that reads the image printed on the recording paper 16, performs the required signal process or the like to determine the printing conditions (the presence or absence of discharge, variation in droplet impact, or the like), and provides the results of this determination to the print controller 180. The timing at which the line sensor begins reading is determined from the distance between the sensor and the nozzles, and the speed at which the recording paper 16 is conveyed.

The print controller 180 performs various corrections as necessary in relation to the head 50 on the basis of the information obtained from the print determination unit 24. Also, the print controller 180 distinguishes between a successful discharge and a discharge failure in the nozzles 51 on the basis of the determination information obtained via the print determination unit 24, and performs control for implementing a specific restoring operation when a nozzle that has failed to discharge is identified.

Film Forming Method by Spray Deposition

Next, the method for manufacturing the head 50 will be described. In the present embodiment, first the film forming method in which the aerosol deposition method is used in order to create a group of substantially cylindrical piezoelectric members by the aerosol deposition method will be generally described. The aerosol deposition method is a film forming technique for forming a film by creating an aerosol from a pulverulent raw material, spraying the aerosol onto a substrate, and depositing the powder by means of the impact energy.

Figure 10:
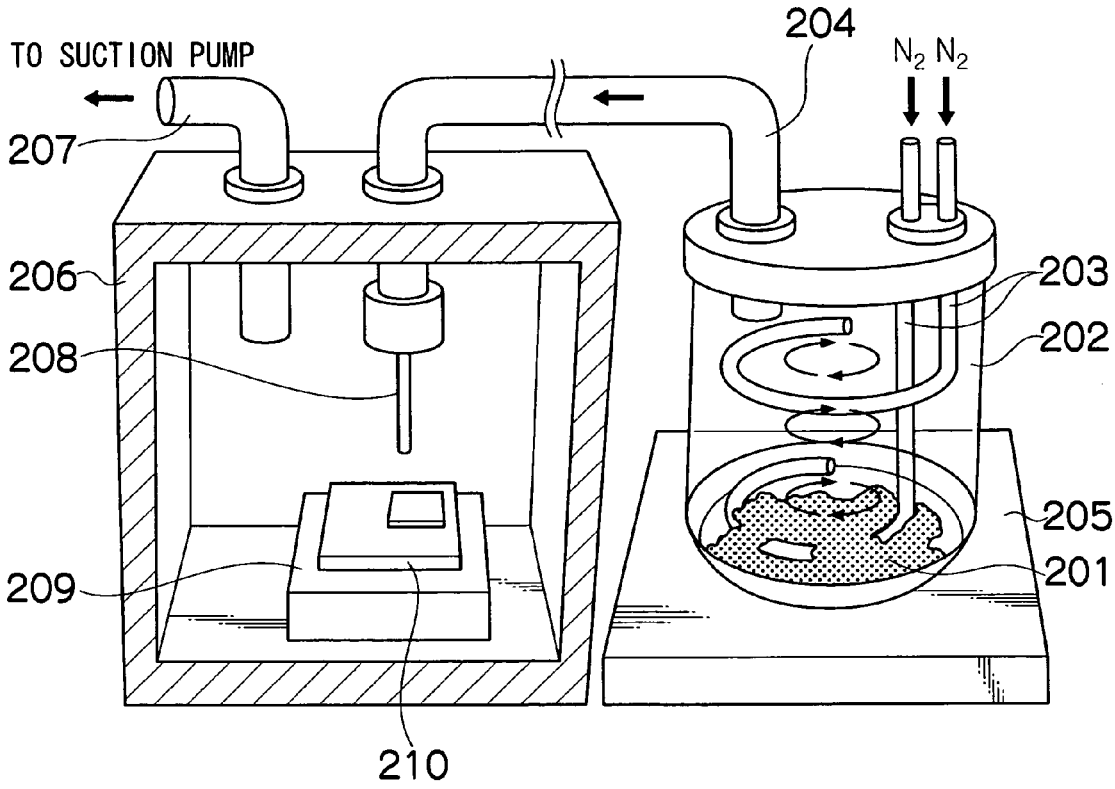
FIG. 10 is a schematic view showing a film forming apparatus that uses the aerosol deposition method.

FIG. 10 is a schematic view showing a film forming apparatus using the aerosol deposition method. This film forming apparatus has an aerosol-producing container 202 for holding raw material powder 201. The term "aerosol" used herein refers to microparticles of a solid or liquid suspended in a gas.

The aerosol-producing container 202 is provided with a carrier gas inlet 203, an aerosol outlet 204, and a vibrating unit 205. The raw material powder held in the aerosol-producing container 202 is blown upward by nitrogen gas ($N_2$) or the like from the carrier gas inlet 203, and an aerosol is produced. The raw material powder is stirred by causing vibration in the aerosol-producing container 202 with the vibrating unit 205, and an aerosol is efficiently produced. The produced aerosol is led through the aerosol outlet 204 into a film-forming chamber 206.

The film-forming chamber 206 is provided with an exhaust tube 207, a spray nozzle 208, and a movable stage 209. The exhaust tube 207 is connected to a vacuum pump (not shown) to expel gas from the interior of the film-forming chamber 206. The aerosol produced in the aerosol-producing container 202 and led through the aerosol outlet 204 into the film-forming chamber 206 is sprayed from the spray nozzle 208 onto a substrate 210. The raw material powder thereby collides with the substrate 210 and is deposited thereon. The substrate 210 is mounted on the movable stage 209 that is capable of moving in three dimensions, and the relative positions of the substrate 210 and the spray nozzle 208 are adjusted by controlling the movable stage 209.

Head-manufacturing Steps

The head 50 in the present example is manufactured according to the sequence of steps (steps 1 to 5) shown below. FIGS. 11A to 11E are diagrams showing the steps of manufacturing the head 50, and the sequence of these steps is described as follows.

Figure 11A:
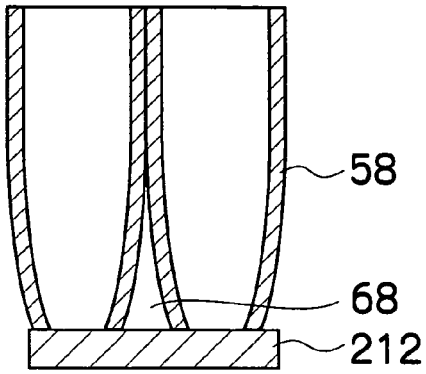
FIGS. 11A to 11E are explanatory diagrams used to describe the step of manufacturing the head of the present example.

(Step 1) A resin mold 58 with a cylindrical hollowed structure that will serve as the "mold" of the external electrode 60 is prepared on a supporting plate (supporting substrate) 212 (FIG. 11A). A molded member made of a resin is used in the present example, but another possibility is an embodiment wherein a mold made of metal is used.

Figure 11D:
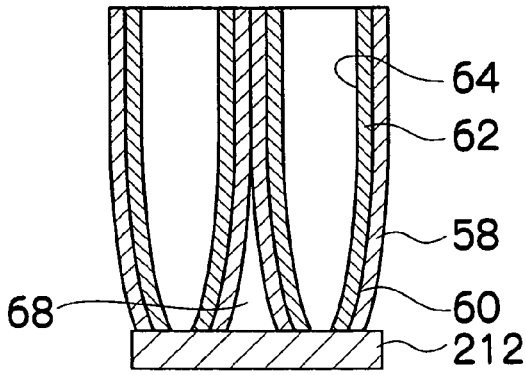
Figure 11B:
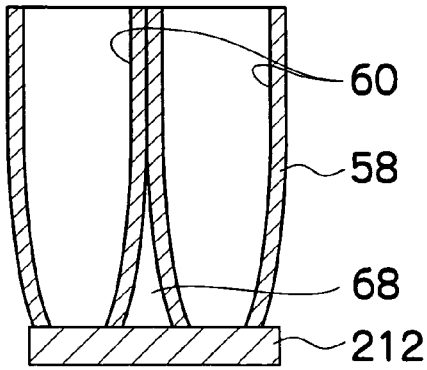

(Step 2) The external electrode 60 is formed on the inner wall of the resin mold 58 by electroless deposition or vapor deposition (FIG. 11B). If the mold member is made of metal, the step for forming the external electrode is not needed because the mold member itself can serve as a common electrode.

Figure 11E:
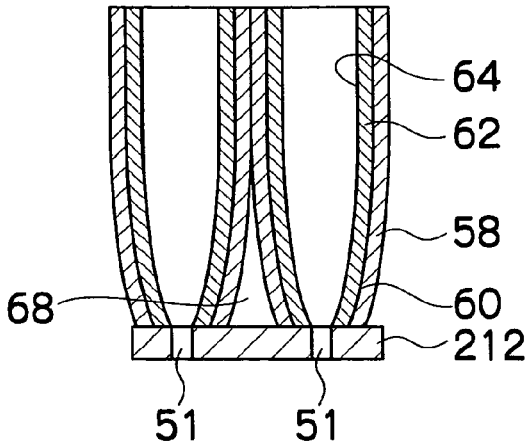
Figure 11C:
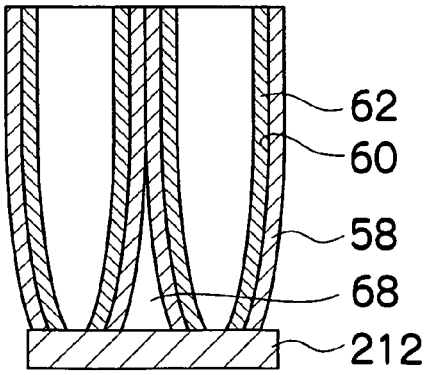

(Step 3) Piezoelectric material is bonded to the inner wall of the external electrode 60 by the aerosol deposition method, and a layer of a cylindrical piezoelectric member 62 is formed (FIG. 11C).

Figure 12:
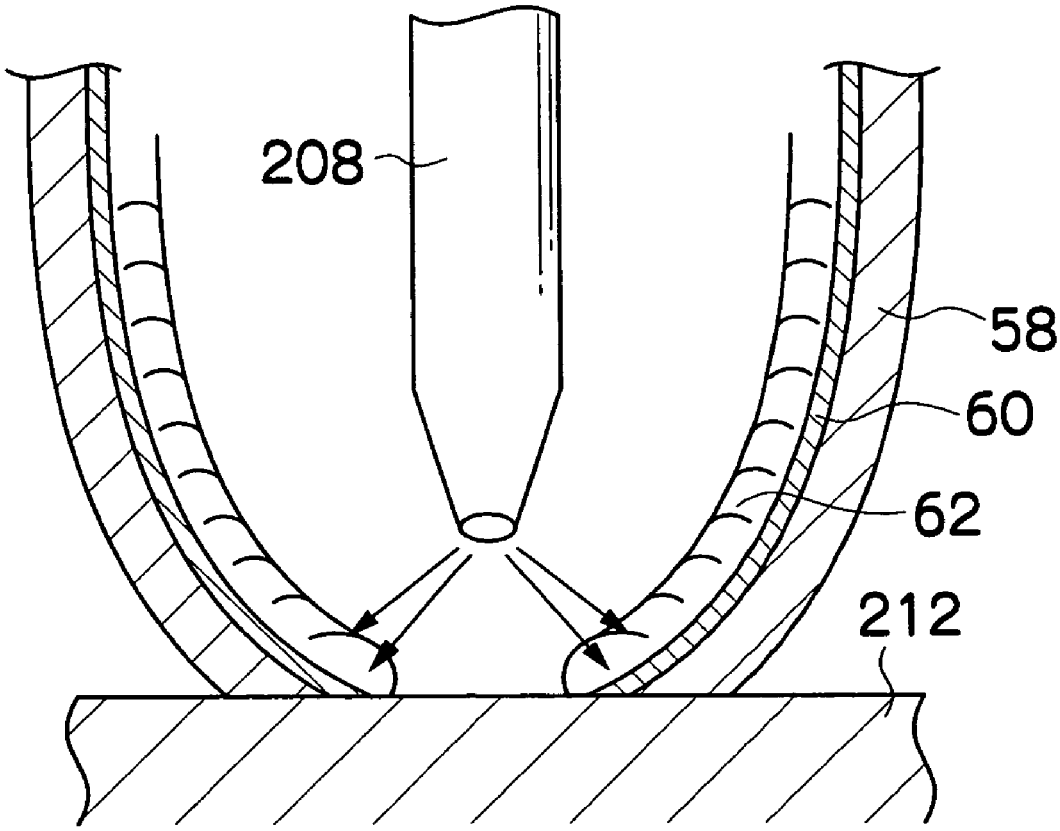
FIG. 12 is a general cross-sectional view showing the step of forming a piezoelectric member by the aerosol deposition method.

FIG. 12 is an enlarged cross-sectional view showing the formation of a piezoelectric layer by the aerosol deposition method. As shown in this diagram, the spray nozzle 208 for spraying microparticles is inserted into the hollow part of the resin mold 58, and microparticles of the piezoelectric material are bonded to the inner wall of the external electrode 60. At this time, either the resin mold 58 supported on the supporting plate 212, or the spray nozzle 208 is moved in the vertical direction in FIGS. 11A to 11E (the axial direction of the resin mold 58 with the cylindrical hollowed structure) and the relative positional relationship of both these members is varied, whereby the piezoelectric members 62 are sequentially bonded to the inner walls of the external electrodes 60 along the axial direction from the ends of the external electrodes 60 (the bottom end in FIG. 12).

Also, the compositions of the piezoelectric members 62 can be varied in the axial direction by switching the powder material sprayed from the spray nozzle 208 or by intermittently or continuously varying the mixture ratio of the plurality of powder types.

Thus, a cylindrical piezoelectric layer with a piezoelectric constant that differs in the axial direction is formed.

(Step 4) After the piezoelectric layer is formed, the internal electrode 64 is formed on the inner wall of the cylindrical piezoelectric member 62 by electroless deposition, vapor deposition, or the aerosol deposition method, as shown in FIG. 11D.

(Step 5) A nozzle hole 51 that will serve as an ink discharge port is formed on the supporting plate 212 that supports the resin mold 58 (FIG. 11E). Otherwise, a nozzle plate 52 provided with nozzle holes is formed separately, the supporting plate 212 is removed after (Step 4), and the nozzle plate 52 may then be bonded with an adhesive or the like. Another possibility is an embodiment wherein the nozzle plate 52 in which nozzle holes are formed is used as the supporting plate 212 in (Step 1), in which case deposition is performed by the aerosol deposition method with the nozzle holes in a masked state, and the mask is removed after (Step 4). Also, an ink-resistant treatment liquid is preferably applied to the inner wall of the internal electrode 64 to form a treated layer.

As described above, according to the embodiment of the present invention, a simple electrode formation method and piezoelectric member formation method can be employed, and the productivity of the head 50 is therefore improved.

Also, when creating a "mold" with a cylindrical hollowed structure, the mold can be formed by resin molding or the like with a diameter of 300 μm and a length of about 2 mm, for example, and it is possible to form an electrode on the inner side thereof by plating or vapor deposition, or to form a piezoelectric member by inserting the spray nozzle 208 for the aerosol deposition method. Therefore, as described in FIG. 4, it is possible to increase the density of the nozzles 51 by disposing the hollowed structure in a two-dimensional manner.

Furthermore, since the final inner diameter of the pressure chambers 56 can be narrowed towards the nozzle 51 of the cylindrical end portion while being gradually varied to be approximately equal to the nozzle diameter, a structure with a flow channel that is profluent towards the nozzle 51 can be created. It is thereby possible to avoid pressure loss and unsatisfactory discharges due to the accumulation of air bubbles.

Other Structural Examples of Piezoelectric Actuator

FIGS. 13A to 13D show other structural examples of the piezoelectric actuator. Components in these diagrams that are identical or similar to those in FIG. 5 are denoted by the same numerals, and descriptions thereof are omitted.

Figure 13A:
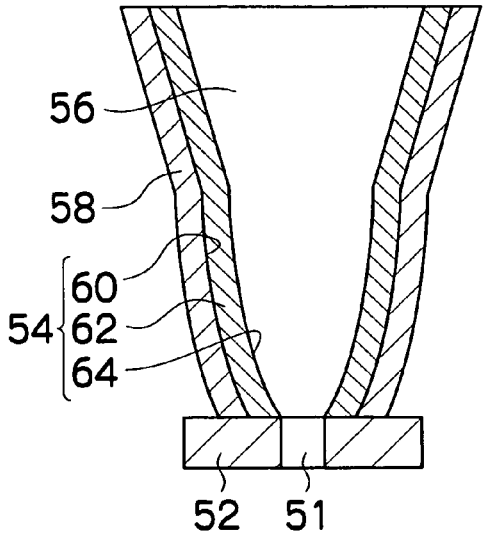
FIGS. 13A to 13D are cross-sectional views showing another structural example of a piezoelectric actuator.

In FIG. 13A, the piezoelectric actuator has a tapered structure wherein the inner diameter of the pressure chamber 56 (flow channel cross section) gradually decreases towards the nozzle 51 part at the end of the axial direction. In this diagram, the shape is regulated by the inner peripheral surface of the resin mold 58, and a piezoelectric member 62 with a uniform thickness (film thickness) is formed on the inner peripheral surface.

Figure 13B:
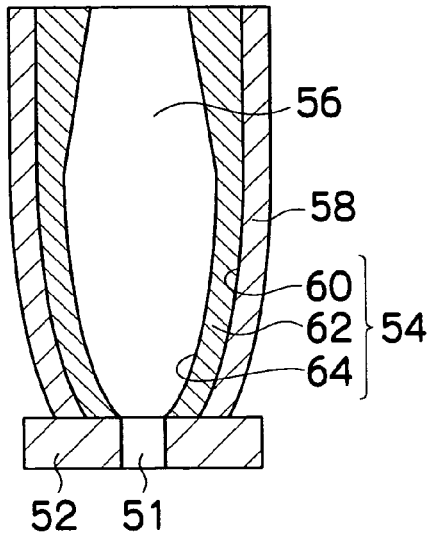

In FIG. 13B, the piezoelectric actuator has a structure wherein the film thickness of the piezoelectric member 62 partially differs, and also has a structure wherein the inner diameter of the pressure chamber 56 gradually varies. The displacement characteristics of the piezoelectric actuator 54 can be made to differ in the axial direction by varying the thickness of the piezoelectric layer either instead of or together with varying the composition of the piezoelectric member 62. In this diagram, the piezoelectric actuator is configured such that the inner diameter of the pressure chamber 56 gradually widens from the ink supply side to the center of the pressure chamber 56 in the axial direction, and then gradually narrows towards the nozzle 51.

Figure 13C:
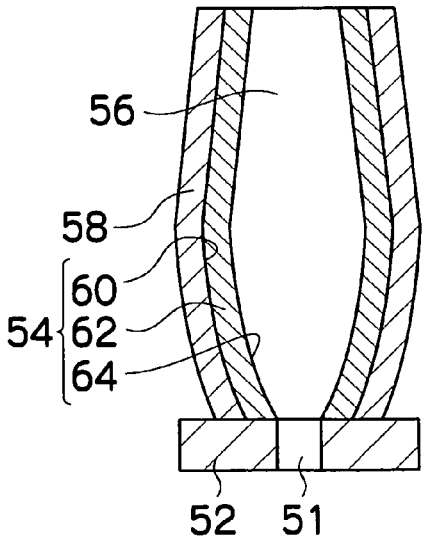

In FIG. 13C, the piezoelectric actuator has a structure wherein the thickness of the piezoelectric layer is constant (including cases in which the thickness is virtually constant so as to appear substantially constant), but the inner diameter of the pressure chamber 56 varies in the axial direction according to the shape of the resin mold 58.

Figure 13D:
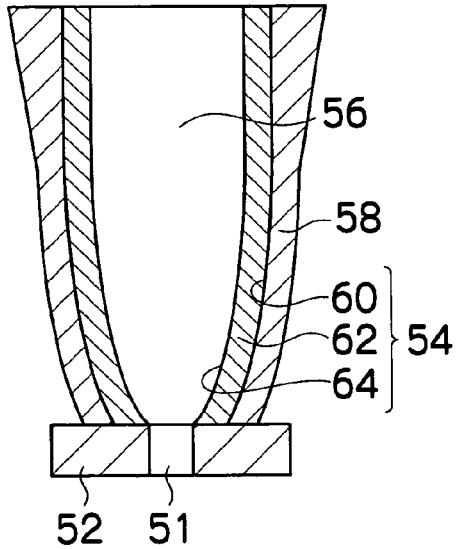

In FIG. 13D, the piezoelectric actuator has a structure wherein the thickness of the piezoelectric layer is constant (including cases in which the thickness is virtually constant so as to appear substantially constant), but the thickness of the resin mold 58 is varied in the axial direction. Since the rigidity of the mold member for supporting the piezoelectric actuator 54 affects the displacement of the piezoelectric actuator 54, the displacement characteristics of the piezoelectric actuator 54 can be varied by varying the thickness of the resin mold 58.

As described above, the contraction amount or contraction timing during voltage application can be made to differ due to a configuration wherein the composition and/or thickness of the piezoelectric member 62 is varied along the axial direction of a cylindrical shape, the inner wall of the pressure chamber 56 is tapered towards the nozzle 51, and the thickness or inner diameter of the mold is varied. It is thereby possible for the pressure chamber 56 to deform so as to expel ink, the discharge force can be improved, and the speed of refilling can be increased.

Modifications

Figure 14:
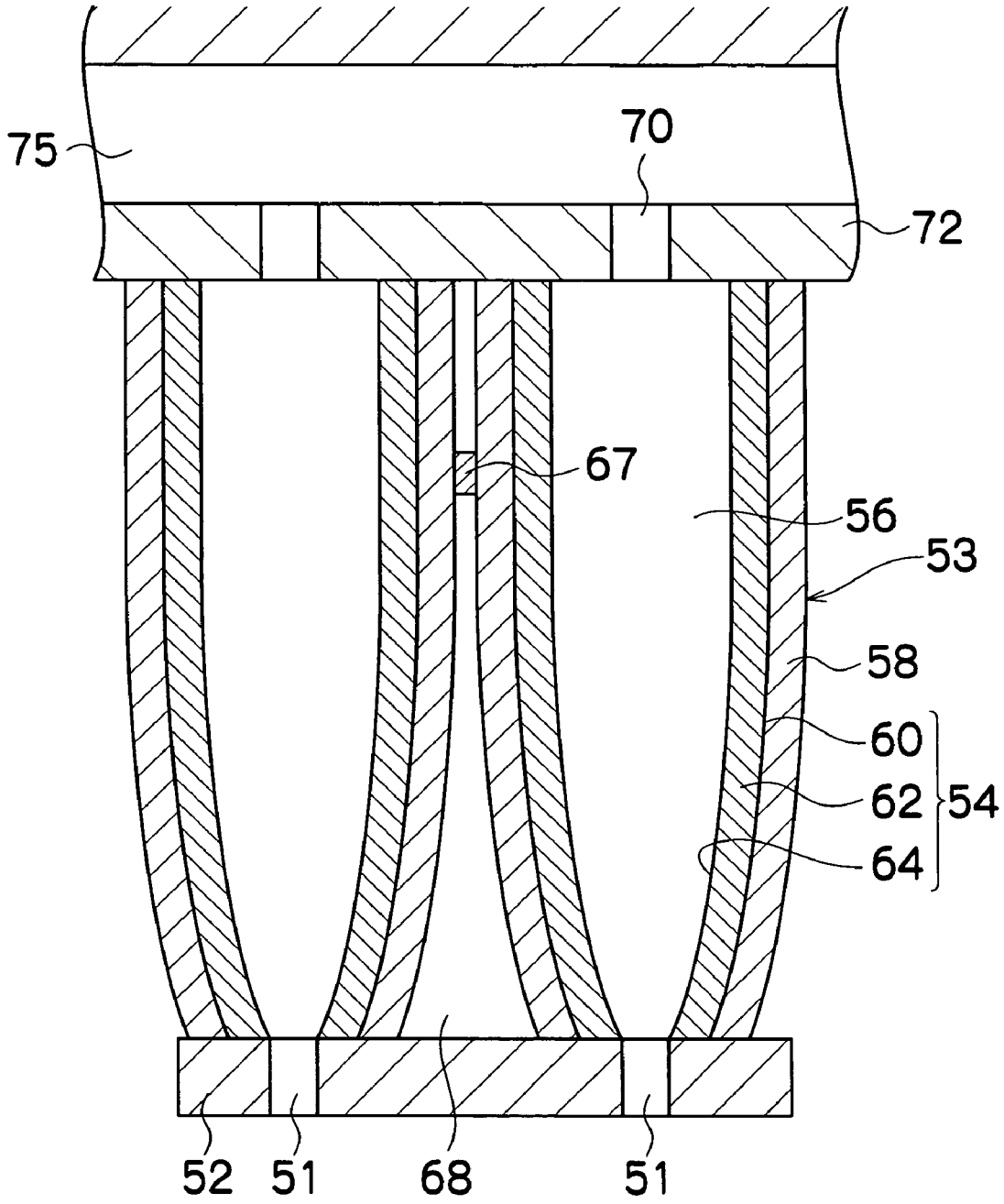
FIG. 14 is a cross-sectional view showing another structural example of the ink chamber unit corresponding to each nozzle.

A configuration such as the one shown in FIG. 14 can be used instead of the configuration for the resin mold 58 shown in FIG. 5. Components in FIG. 14 that are identical or similar to those in FIG. 5 are denoted by the same numerals, and descriptions thereof are omitted. Specifically, as shown in FIG. 14, the adjacent resin molds 58 are linked to each other via a link 67. This link 67 is preferably small enough so that there is no interference in operation between adjacent nozzles, or is formed from a sufficiently elastic material.

Handling during manufacture is simplified by a structure wherein multiple resin molds 58 are integrally linked by a link 67.

In the embodiments described above, a structure was depicted in which the inner peripheral surface of the piezoelectric actuator 54 (the internal electrode 64 or the ink-resistant treated layer that covers the internal electrode 64) directly constitutes the side wall of the pressure chamber 56 (an integral structure system wherein the piezoelectric actuator also serves as a member for forming a pressure chamber), but implementing the present invention is not limited to this example. For example, another possibility is a configuration wherein a side wall layer of a cylindrical pressure chamber (member for forming the pressure chamber) is also formed on the inner peripheral surface of the piezoelectric actuator from a resin or another such material (a separate structure system in which the piezoelectric actuator is disposed on the outer periphery of the member for forming a pressure chamber).

Also, in the above descriptions, an inkjet recording apparatus was depicted as an example of an image forming apparatus, but the applicable scope of the present invention is not limited thereto. For example, the droplet discharge head of the present invention can also be applied to a photographic image forming apparatus or the like wherein a developer is applied without coming in contact with the printing paper. Also, the applicable scope of the droplet discharge head relating to the present invention is not limited to an image forming apparatus, and the present invention can also be applied to various apparatuses (painting apparatuses, coating apparatuses, wiring, lithography apparatuses, and the like) that use a discharge head to spray a treatment liquid or other various liquid onto a medium for discharge.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method for manufacturing a liquid droplet discharge head having a plurality of droplet discharge ports and piezoelectric actuators for creating pressure variation in liquid in pressure chambers communicated with the droplet discharge ports to discharge droplets of the liquid from the droplet discharge ports, the method comprising the steps of:

providing a molded member having hollow cylindrical shapes constituting the pressure chambers;

depositing particles of a piezoelectric material by spray deposition on inner walls of the molded member thereby forming cylindrical piezoelectric members; and forming electrodes on inner walls of the cylindrical piezoelectric members, wherein forming the cylindrical piezoelectric members includes:

varying intermittently or continuously compositions of the cylindrical piezoelectric members along an axial direction of the molded member.

2. The method as defined in claim 1, wherein providing the molded member includes disposing the molded member two-dimensionally according to an alignment configuration of the droplet discharge ports.

3. The method as defined in claim 1, wherein depositing particles of a piezoelectric material includes:

inserting a spray nozzle in an inner side of the molded member for spraying microparticles; and sequentially forming the cylindrical piezoelectric members in the axial direction of the molded member by spraying particles of at least the piezoelectric material from the spray nozzle.

4. The method as defined in claim 1, further comprising:

forming the plurality of droplet discharge ports on a plate member bonded to ends of the molded members in the axial direction.

5. A method for manufacturing a liquid droplet discharge head having a plurality of droplet discharge ports and piezoelectric actuators for creating pressure variation in liquid in pressure chambers communicated with the droplet discharge ports to discharge droplets of the liquid from the droplet discharge ports, the method comprising the steps of:

providing a molded member having hollow cylindrical shapes constituting the pressure chambers;

depositing particles of a piezoelectric material by spray deposition on inner walls of the molded member thereby forming cylindrical piezoelectric members; and forming electrodes on inner walls of the cylindrical piezoelectric members;

forming the plurality of droplet discharge ports on a plate member bonded to ends of the molded members in an axial direction of the molded member;

forming a flow channel of the pressure chamber on an inner side of the cylindrical piezoelectric member, the flow channel having a substantially circular cross section; and progressively decreasing an inner diameter of the pressure chamber towards the droplet discharge port at the end in the axial direction.

6. A method for manufacturing a liquid droplet discharge head having a plurality of droplet discharge ports and piezoelectric actuators for creating pressure variation in liquid in pressure chambers communicated with the droplet discharge ports to discharge droplets of the liquid from the droplet discharge ports, the method comprising the steps of:

providing a molded member having hollow cylindrical shapes constituting the pressure chambers;

depositing particles of a piezoelectric material by spray deposition on inner walls of the molded member thereby forming cylindrical piezoelectric members; and forming electrodes on inner walls of the cylindrical piezoelectric members, wherein forming the cylindrical piezoelectric members includes:

varying intermittently or continuously a thickness of the cylindrical piezoelectric members along an axial direction of the molded member.

7. The method as defined in claim 6, wherein providing the molded member includes disposing the molded member two-dimensionally according to an alignment configuration of the droplet discharge ports.

8. The method as defined in claim 6, wherein depositing particles of a piezoelectric material includes:

inserting a spray nozzle in an inner side of the molded member for spraying microparticles; and sequentially forming the cylindrical piezoelectric members in the axial direction of the molded member by spraying particles of at least the piezoelectric material from the spray nozzle.

9. The method as defined in claim 6, further comprising:

forming the plurality of droplet discharge ports on a plate member bonded to ends of the molded members in the axial direction.

* * * * *